US005764095A

United States Patent [19]

Carobolante

[11] Patent Number: 5,764,095

[45] Date of Patent: Jun. 9, 1998

[54] NONLINEAR INTEGRATOR

[75] Inventor: Francesco Carobolante, Scotts Valley, Calif.

[73] Assignee: SGS-Thomson Microelectronics, Inc., Carrollton, Tex.

[21] Appl. No.: 611,565

[22] Filed: Mar. 6, 1996

[51] Int. Cl.[6] ..... G06G 7/64

[52] U.S. Cl. ..... 327/345; 327/336; 327/341; 327/67

[58] Field of Search ..... 327/65, 66, 67, 327/73, 77, 87, 89, 336, 341, 345, 362, 363, 560–563, 170, 134, 91, 94, 538; 330/259

[56] References Cited

U.S. PATENT DOCUMENTS

| | | | |
|---|---|---|---|
| 4,887,048 | 12/1989 | Krenik et al. | 330/258 |
| 5,187,448 | 2/1993 | Brooks et al. | 330/258 |
| 5,239,210 | 8/1993 | Scott | 327/362 |
| 5,293,445 | 3/1994 | Carobolante | 388/613 |
| 5,471,169 | 11/1995 | Dendinger | 327/67 |
| 5,475,323 | 12/1995 | Harris et al. | 327/65 |
| 5,508,656 | 4/1996 | Jaffard et al. | 330/259 |

*Primary Examiner*—Toan Tran

*Attorney, Agent, or Firm*—Theodore E. Galanthay; Lisa K. Jorgenson; Renee M. Larson

[57] ABSTRACT

A non-linear integrator of a closed loop integration system selectively modifies the gain of the closed loop integration system in order to avoid system saturation while still experiencing high gain in a desired linear portion of the system. A non-linear integrator structure and method allow the gain of the closed loop integration system to be selectively modified in order to avoid saturation while experiencing high gain. The non-linear integrator includes an amplifier, a current source element which generates a bias input signal, a bias circuit which provides the bias input signal to the amplifier and allows the bias input signal to be selectively modified, a storage element coupled to the amplifier, and a gain element, coupled to the storage element, which produces an output signal determined by voltage on the storage element. A voltage input signal and a bias input signal are supplied to the amplifier which generates an amplifier output signal. The gain of the amplifier may be selectively modified by modifying the bias input signal to the amplifier by means of the bias circuit.

25 Claims, 1 Drawing Sheet

NONLINEAR INTEGRATOR

BACKGROUND OF THE INVENTION

The present invention relates generally to closed loop integration systems, and more specifically to closed loop integration systems in which it is desirable to modify the gain of the system to avoid saturation while still experiencing high gain in a desired linear portion of the system.

In many applications there exists the need to accomplish "Integration" of a signal through use of an integrator function. In a given integration system, it may be desirable to have both a large system gain, in order to maximize the signal-to-noise ratio, and a large range of system linearity. Unfortunately, the two requirements of large gain and large range of linearity are often in antithesis to one another because of the limited supply voltages available to most integration systems. The first requirement of a large system gain is especially of concern when the integrator function is part of the conversion from a digital signal to an analog signal, where often the information encompassed in the digital signal is processed before being converted to an analog signal in order to preserve noise immunity. In this instance, it is desirable to make the signal as large as possible through a large system gain function in order to minimize signal degradation due to noise or parasitic effects, thus providing a certain amount of noise immunity. Additionally, a system having a large gain is typically very accurate. The second requirement of a large range of system linearity is related to the need to avoid "saturation "of the signal, a requirement often related to the dynamic response of the system.

Typically it is difficult to simultaneously obtain both a large gain and a large range of linearity for a given integration system. When a system has a large enough gain, it may be thrown into saturation where the benefits of large gain and high accuracy are outweighed by the non-linearity introduced to the system at saturation. In fact, the non-linearity introduced at saturation may be the only non-linearity present in the system. The introduction of saturation also destroys the transfer function of the system. Additionally, while the system is in saturation, the system bandwidth is unstable. Thus, saturation results in system instability which is manifested through prolonged settling time of the system, often referred to as "bang-bang operation". Once in saturation, the system will attempt to recover by moving away from saturation back towards the linear portion, or origin, of the system, an activity known as "slamming ". Needless to say, both "bang-bang"and "slamming"are undesirable results of system saturation which occur when there is high system gain but only limited dynamic range of the system. Thus, in a system having high gain, it is desirable that the system allow for enough dynamic range in order to avoid system saturation.

Yet another undesirable consequence of system saturation is its effect on the error signal of a closed loop integration system. A system having a high gain and high accuracy usually has a small system error which is in tension with a large linear region which is more stable and controlled but which has a larger system error. Generally speaking, when the system is thrown into saturation, the larger the gain of the closed loop system, the longer the system will remain in saturation and thus the lower the error gain. For a system having a large gain, it is thus an objective to quickly return from saturation to a linear region of the system, referred to as a "lock in range", near the origin of the system or other suitable settling point region of the system.

SUMMARY OF THE INVENTION

It would be advantageous in the art to allow for more dynamic range of a closed loop integration system having a high gain characteristic in order to avoid system saturation.

It would further be advantageous in the art to selectively modify the gain of a closed loop integration system in order to avoid system saturation while still experiencing high gain in a desired linear portion of the system.

Therefore, according to the present invention, a non-linear integrator of a closed loop integration system selectively modifies the gain of the closed loop integration system in order to avoid system saturation while still experiencing high gain in a desired linear portion of the system. The elements of the non-linear integrator include an amplifier which is provided a voltage input signal and a bias input signal to produce an amplifier output signal, a current source element which generates the bias input signal, a bias circuit which provides the bias input signal to the amplifier, wherein the bias circuit is comprised of a first bias source which produces a first current and/or a second bias source which produces a second current, each capable of modifying the bias input signal to the amplifier, a storage element coupled to the amplifier output signal of the amplifier, and a gain element, coupled to the storage element, which produces an output signal determined by voltage on the storage element.

Additionally, the present invention discloses a method for selectively modifying the gain of a non-linear integrator of a closed loop system in order to avoid saturation in the acquisition range of the closed loop system while still experiencing a high gain characteristic at a desired linear portion of the system. The steps of the method include supplying a voltage input signal and a bias input signal to an amplifier of the non-linear integrator, generating an amplifier output signal of the amplifier, and selectively modifying the gain of the amplifier as reflected in the amplifier output signal.

BRIEF DESCRIPTION OF THE DRAWINGS

The novel features believed characteristic of the invention are set forth in the appended claims. The invention itself, however, as well as a preferred mode of use, and further objects and advantages thereof, will best be understood by reference to the following detailed description of an illustrative embodiment when read in conjunction with the accompanying drawings, wherein:

DESCRIPTION OF THE INVENTION

The non-linear integrator of a closed loop integration system of the present invention satisfies the demand for two conflicting characteristics of the system: high gain and high accuracy which is indicative of an integration system having small error, and low gain with a larger linear region which is indicative of a more stable and controlled integration system having a larger error. The non-linear integrator of the present invention selectively modifies the gain of a closed loop system in order to avoid saturation in the acquisition range of the system while still experiencing a high gain characteristic at a desired linear portion of the system, such as at the system origin (which may be 0 volts) or at some other desired settling point of the system.

Such a non-linear integrator of a closed loop integration system may be achieved by appropriately modifying the integrating constant k in the following general equation:

$$y=k\int x dt \quad (1)$$

As indicated in equation 1, the integrating block of a closed loop system may be made non-linear through appropriate manipulation of either x, the input signal of the system, or y, the output signal of the system, since the integrating constant k may be a function of either the input signal x or the output signal y as indicated by the following equations:

$$k=k(x) \quad (2)$$

$$k=k(y) \quad (3)$$

Additionally, through the definition of k, the transfer function of the closed loop system may be continuous or discontinuous, i.e. may have any number of values such as 1, 2, 3, . . . ∞, and, although infinite-valued, the transfer function may not necessarily be a linear function since it may have up to an infinite number of derivatives and thus be discontinuous. It should be noted that while other inventions, such as those disclosed in U.S. Pat. Nos. 5,293,445 and 5,329,560 address the use of multiple discontinuities or breakpoints, the present invention provides for the use of multiple breakpoints as well as an infinite number of breakpoints. Non-linearities in the transfer function can be created by making the transfer function either continuous or discontinuous. The transfer function may be made continuous by using the inherent non-linearities of transistor or diode technology as shown in FIG. 1, or the transfer function may be made discontinuous in any of its derivatives in a variety of ways, such as using switchable gains or counters with different clock frequencies.

Figure 1:
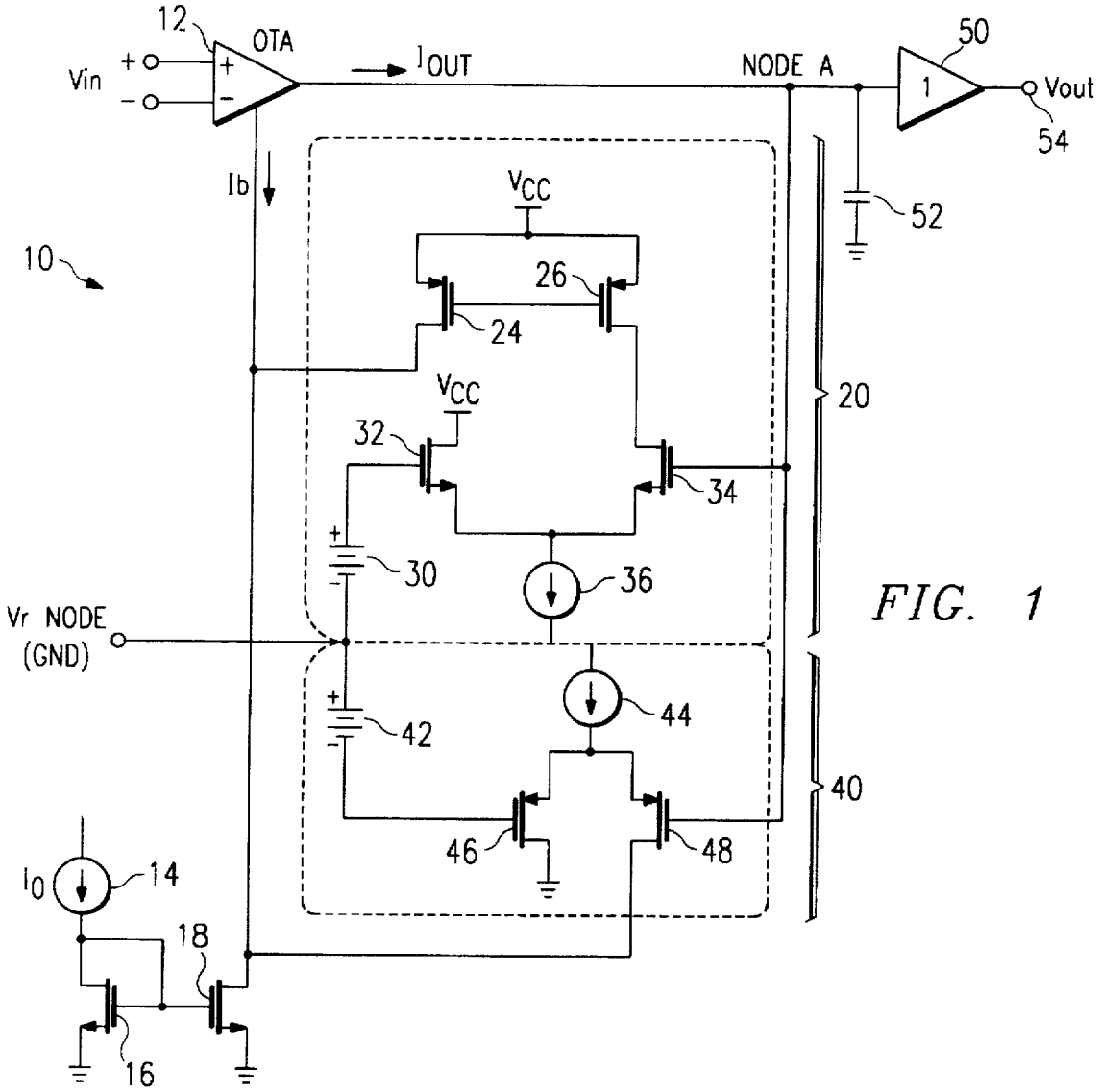
FIG. 1 is a schematic of non-linear integrator circuitry 10, according to the present invention.

Referring to FIG. 1, a non-linear integrator circuitry 10 according to the present invention is shown. Non-linear integrator circuitry 10 includes the following elements: operational transconductance amplifier (OTA) 12; I0 current source 14, transistors 16, 18, 24, 26, 32, 34, 46, and 48; current source 36; current source 44; capacitor 52; and gain stage 50. Differential voltage input signal Vin is provided to OTA 12; OTA 12 is biased by a bias input signal represented by bias current Ib. The value of bias current Ib is determined by bias source 20 and bias source 40. Bias source 20 has the following elements: transistors 24, 26, 32, and 34; bias voltage 30; and current source 36. Bias source 20 contains a current mirror composed of transistors 24 and 26 and a differential pair composed of transistors 32 and 34, bias voltage 30, and current source 36. The gates of transistors 24 and 26 are electrically connected. A first source/drain of transistor 24 and a first source/drain of transistor 26 is electrically connected to supply voltage Vcc as shown. A second source/drain of transistor 24 is electrically connected to bias input Ib. A second source/drain of transistor 26 is electrically connected to a first source/drain of transistor 34. The gate of transistor 34 is electrically connected to Node A which is defined as the electrical connection of the gate of transistor 34, the positive terminal of capacitor 52, an input terminal of gain stage 50, the Vr ground, and the gate of transistor 48. A first source/drain of transistor 32 is electrically connected to supply voltage Vcc. The gate of transistor 32 is electrically connected to the positive terminal of bias voltage 30. A negative terminal of bias voltage 30 is electrically connected to Vr node. A second source/drain of transistor 32 and a second source/drain of transistor 34 are electrically connected to current source 36 as shown.

Bias source 40 has the following elements: bias voltage 42, current source 44, and transistors 46 and 48. Bias source 40 contains also contains a differential pair composed of bias voltage 42, current source 44, and transistors 46 and 48. Current source 44 is electrically connected to a first source/drain of transistors 46 and 48. The gate of transistor 46 is electrically connected to the negative terminal of bias voltage 42. The positive terminal of bias voltage 42 is electrically connected to Vr node. A second terminal of transistor 46 is electrically connected to ground potential. A gate of transistor 48 is electrically connected to Node A. A second source/drain of transistor 48 is electrically connected to bias current Ib which flows into a first source/drain of transistor 18; a second source/drain of transistor 18 is electrically connected to ground potential. A gate of transistor 18 is electrically connected to a gate of transistor 16 as shown. I0 current source 14 flows into a first source/drain of transistor 16; a second source/drain of transistor 16 is electrically connected to ground potential.

Operational Transconductance Amplifier (OTA) 12 is provided with differential voltage input signal Vin and is biased by bias current Ib at a bias input to produce output current signal Iout as a function of $K_{OTA}$, the OTA gain. Output current Iout is defined by the following equation:

$$Iout=K_{OTA}\times Ib(Vin) \quad (4)$$

Figure 2:
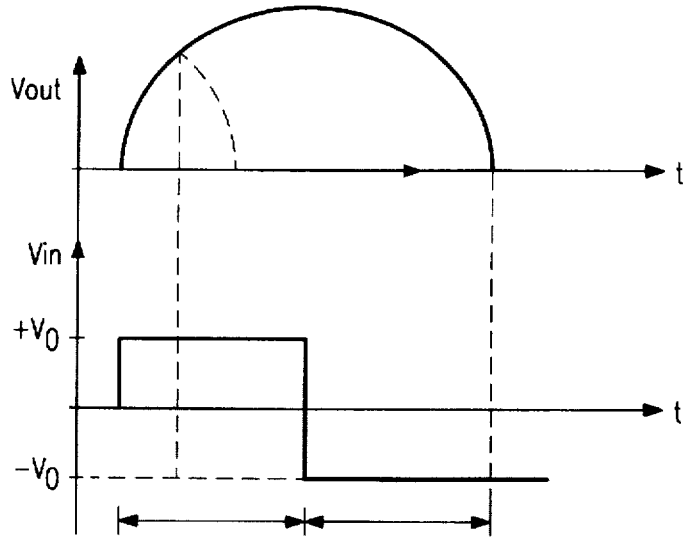
FIG. 2 is a graph which illustrates changes over time of output voltage signal Vout and input differential voltage signal pair Vin of non-linear integrator circuitry 10, according to the present invention.

Bias current Ib is generated as a function of I0 current source 14 connected to transistors 16 and 18. When bias source 20 or bias source 40 are off, then bias current Ib is equal to I0 current source 14. The current I0 of current source 14 will go through transistor 16 to ground potential, and is mirrored through transistor 18. The voltage through capacitor 52 ramps up and the current conducted through the bias sources 20 or 40. Bias current Ib will decrease by the amount of current supplied by the bias sources 20 or 40, depending on whether the non-linear integrator circuitry 10 is operating in the positive or negative voltage range. As the bias sources 20 or 40 turn on, bias current Ib is decreased by the amount of current provided by the circuitry in the bias sources 20 or 40. The current mirror and differential pair of bias source 20 operate to decrease the value of bias current Ib for operation of non-linear integrator circuitry 10 in a positive voltage range (i.e. above 0 volts), while the differential pair of bias source 40 operates to decrease the value of bias current Ib for operation of non-linear integrator circuitry 10 in a negative voltage range (i.e. below 0 volts). The output voltage Vout of circuitry 10 is determined by the voltage on capacitor 52 after passing through a unity gain 50. Referring to FIG. 2, a graph illustrates the changes of output voltage signal Vout and input differential voltage signal pair Vin over time. The graph of FIG. 2 is the result of only positive bias source 20; thus FIG. 2 does not illustrate operation of non-linear integrator circuitry 10 in a negative voltage range.

The non-linear integrator of the present invention provides an additional integrating function which implies an infinite gain at the origin or other desired settling point of the closed loop system over traditional closed loop systems. Once direct current operation of the system is achieved, the system error is zero. For closed loop acquisition systems, the non-linear integrator is placed after the gain shaping transfer function of the system such that the highest gain of the system is achieved at the origin or at some other desired settling point where the error of the system approximates zero. This prevents the system from going into saturation where the system is unstable—typically away from the origin. The non-linear integrator is placed in the forward transfer function path at a point after the error signal is generated to drive the error signal towards zero. The forward transfer function could be a variety of components typical of closed loop systems, such as a phase detector composed of a summing junction with a non-unity gain, filter, and integrator; the filter and integrator may be a single component of the loop system.

The area of interest is that portion of the closed loop system near the origin; thus, small signal analysis is important. The present invention purposefully allows the closed loop system to become non-linear and distorted while in acquisition in the large signal range because after the transient period the system will settle around the origin. It is more important that the system be kept out of saturation for small signals around the origin where gain approaches an infinite value. The present invention ensures that the local linear system near the origin does not go into saturation such that the input signal of the system maintains a non-zero relationship to the output signal of the system. In effect, the dynamic range of the input signals for which output signals will change, with varying amounts of gain, is extended with the result that the transfer function of the system need not be constant so long as the gain is non-zero. This condition provides a non-zero small signal transfer function for larger dynamic range of the error signal such that the system will not go into saturation for a large range of error signal.

An example in which the non-linear integrator will be very useful is the following description of a timer where high gain and high accuracy (resolution) is required for small signals at the origin of the system. Suppose that a counter starts counting upwards from 0, the smallest signal. For many applications, as the timer counts get larger, there is less need for high accuracy and a large dynamic range is important, but it is equally important that the timer not saturate, therefore "losing "the information. In order to ensure a high resolution at zero time without saturating at a larger time, the time may be measured with a high or fine resolution when small and with a coarser resolution when the time is large. Thus, the rate of change of the integrator decreases as the value of time increases and, as the amplitude of the output signal of the integrator increases, the gain of the integrator is decreased. The non-linear integrator is changed such that the gain of the transfer function decreases more and more as the system approaches saturation. The result resembles a logarithmic function; transistors are ideal to achieve this response due to their inherently non-linear nature. In this timer example, the count was performed non-linearly such that counting was conducted faster at first and slower as the time which had elapsed became larger in order to avoid system saturation. The result is a much larger dynamic range of the closed loop system.

By keeping the timer system out of saturation, the input signal of the timer may be reconstructed backwards according to the amount of time which has elapsed as determined from the output signal which has a complete memory of changes made to the transfer function in time. However, if the system does go into saturation, there will be no change in the output signal for any given input signal changes.

The shape transfer function which precedes the non-linear integrator is a non-linear AGC (automatic gain control) which changes the system gain as a function of the error signal. The continuous transfer function provided by the AGC allows the gain of the system to be dynamically changed; small or large change in the output signal can be selectively accomplished for a given change in the input signal of the system. The larger the error signal, the smaller the gain; the smaller the error signal, the larger the gain. This is in contrast to a typical linear AGC which has an amplifier whose gain is modulated by the weighted measure of error signal, and the output signal of amplifier is fed back to the amplifier to modulate the gain of the amplifier. The present invention does not utilize a typical feedback signal of a feedback loop of a linear AGC to modulate the amplitude of output signal. Rather, the present invention uses a local feedback loop on the integral value so that changes in system gain occur very quickly upon changes of the output signal. The gain of the system is dynamically and instantaneously affected for a given change in the input signal.

The non-linear integrator of the present invention is capable of non-linearly changing the transfer function of the closed loop system independent of its signal level, by reducing the characteristic gain of the system as the output signal amplitude increases. The non-linear distortion produced by this non-linear change of the transfer function may be unacceptable in some applications, such as in audio applications in which a companding technique is used to transmit and store information followed by expansion of the signal back to pre-compression levels when the signal is received.

While non-linear change of the system transfer function independent of its signal level may result in unacceptable "distortion" of the signal for such applications, there are many other applications, such as acquisition circuits and timing circuits which utilize compression in an "Integrating""block of the closed loop system in which such non-linear distortion is acceptable. As an example, most closed loop linear systems contain an integrator function which forces the closed loop system to operate in proximity to the origin of the system or at a point corresponding to a zero-level input signal to the integrator, such that a large dynamic range is necessary only to accommodate the transient response of the closed loop system. For these closed loop systems, the non-linearity of the response affects only the transient region of the system operation which is itself inherently inaccurate and thus is not adversely affected by a non-linear response of the system in that region. A closed loop system which settles in the "hear zero" portion of the transfer function can always be made substantially linear in that region if so required, and thus may easily utilize the non-linear integrator of the present invention.

Thus, the present invention will be beneficial in variety of applications, including acquisition circuits and timing circuits. Acquisition systems include such systems as PLLs (phase-locked loops), timers, linear circuits which in general converge to a desired operating point, or other systems where a frequency signal or other signal type is acquired. In a PLL, an input signal can be used to lock the frequency of a voltage controlled oscillator (VCO) to the input signal frequency, and thus a PLL typically has a phase comparator component and a VCO component. PLLs are commonly used in the demodulator portion of an FM radio receiver to acquire the input signal frequency. In the case of a frequency acquisition system, it may be necessary to acquire the desired frequency within a given accuracy, such as within 0.1% or even 0.01% of the desired frequency. The accuracy of the acquisition system is a function of its open loop gain. The higher the gain, the better the accuracy of the system.

While the invention has been particularly shown and described with reference to a preferred embodiment, it will be understood by those skilled in the art that various changes in form and detail may be made therein without departing from the spirit and scope of the invention.

What is claimed is:

1. A non-linear integrator circuit, comprising:

a gain element having a voltage input signal and a bias input signal and generating an amplifier output signal, wherein a transfer function of the gain element is dependent on the bias input signal of the gain element and wherein the gain element has a gain;

an integrating element coupled to the amplifier output signal; and a feedback element, that modifies the bias input signal, coupled to the integrating element to create a non-linear transfer function of the non-linear integrator circuit, wherein the gain of the gain element is automatically decreased as necessary to avoid saturation.

2. The non-linear integrator circuit of claim 1, wherein the gain element is an amplifier.

3. The non-linear integrator of claim 2, wherein the gain element is an operational transconductance amplifier (OTA).

4. The non-linear integrator of claim 1, wherein the integrating element is a storage element.

5. The non-linear integrator of claim 4, wherein the integrating element is a capacitor.

6. The non-linear integrator of claim 1, wherein the feedback element comprises:

a current mirror coupled to a first supply voltage and to the bias input signal; and a differential pair coupled to the current mirror, the amplifier output signal, and the first supply voltage.

7. A non-linear integrator circuit, comprising:

a gain element having a voltage input signal and a bias input signal and generating an amplifier output signal, wherein a transfer function of the gain element is dependent on the bias input signal of the gain element;

an integrating element coupled to the amplifier output signal; and a feedback element, coupled to the amplifier output signal gain element and the bias input signal, that modifies the bias input signal as a function of the amplifier output signal generated by the gain element, wherein the feedback element comprises:

a current mirror coupled to a first supply voltage and to the bias input signal, wherein the current mirror is comprised of a first transistor and a second transistors; and a differential pair, comprised of a third transistor, a fourth transistor, a bias voltage, and a current source, coupled to the current mirror, the amplifier output signal, and the first supply voltage, wherein a gate of the first transistor is coupled to a gate of the second transistor; a first source/drain of the first transistor and a first source/drain of the second transistor are coupled to the first supply voltage; a second source/drain of the first transistor is coupled to the bias input signal; a second source/drain of the second transistor is coupled to a first source/drain of the fourth transistor, the gate of the first transistor, and the gate of the second transistor; a gate of the fourth transistor is coupled to the amplifier output signal; a first source/drain of the third transistor is coupled to the first supply voltage; a gate of the third transistor is coupled to a first terminal of the bias voltage; a second terminal of the bias voltage is coupled to a ground node; a second source/drain of the third transistor and a second source/drain of the fourth transistor are coupled to the current source.

8. The non-linear integrator of claim 7, wherein the current mirror is coupled to a current source element which generates the bias input signal, wherein the current source element comprises a second current source, a fifth transistor and a sixth transistor, wherein the second source/drain of the first transistor is coupled to a first source/drain of the sixth transistor, a second source/drain of the sixth transistor is coupled to the second supply voltage, a gate of the sixth transistor is coupled to a gate of the fifth transistor, a first source/drain of the fifth transistor and the second current source, and a second source/drain of the fifth transistor is coupled to the second supply voltage.

9. The non-linear integrator of claim 8, wherein when the feedback element generates no feedback, the bias input signal is determined by a current generated by the second current source of the current source element; when the feedback element generates feedback, the bias input signal is equal to a current generated by the second current source of the current source element decreased by a current produced by the current source of the differential pair.

10. The non-linear integrator of claim 1, wherein the feedback element comprises:

a differential pair coupled to a second supply voltage, the amplifier output signal, and the bias input signal.

11. A non-linear integrator circuit, comprising:

a gain element having a voltage input signal and a bias input signal and generating an amplifier output signal, wherein a transfer function of the gain element is dependent on the bias input signal of the gain element;

an integrating element coupled to the amplifier output signal; and a feedback element, coupled to the amplifier output signal gain element and the bias input signal, that modifies the bias input signal as a function of the amplifier output signal generated by the gain element, wherein the feedback element comprises a differential pair coupled to a second supply voltage, the amplifier output signal, and the bias input signal, wherein the differential pair comprises a first transistor, a second transistor, a bias voltage, and a current source, wherein a first terminal of the bias voltage is coupled to a ground node, a second terminal of the bias voltage is coupled to a gate of the first transistor, a first source/drain of the first transistor is coupled to the current source, a first source/drain of the second transistor is coupled to the current source, a gate of the second transistor is coupled to the amplifier output signal, a second source/drain of the first transistor is coupled to the second supply voltage, and a second source/drain of the second transistor is coupled to the bias input signal.

12. The non-linear integrator of claim 11, wherein the differential pair is coupled to a current source element which generates the bias input signal, wherein the current source element comprises a second current source, a third transistor and a fourth transistor, wherein the second source/drain of the second transistor is coupled to a first source/drain of the fourth transistor, a second source/drain of the fourth transistor is coupled to the second supply voltage, a gate of the fourth transistor is coupled to a gate of the third transistor, a first source/drain of the third transistor and the second current source, and a second source/drain of the third transistor is coupled to the second supply voltage.

13. The non-linear integrator of claim 12, wherein when the feedback element generates no feedback, the bias input signal is determined by a current generated by the second current source of the current source element; when the feedback element generates feedback, the bias input signal is equal to a current generated by the second current source of the current source element decreased by a current produced by the current source of the differential pair.

14. The non-linear integrator of claim 1, wherein the voltage input signal is a differential voltage input signal pair.

15. The non-linear integrator of claim 1, wherein the amplifier output signal is a current signal.

16. The non-linear integrator of claim 1, wherein the non-linear integrator further comprises:

an output buffer element coupled to the integrating element which produces an output signal of the non-linear integrator determined by voltage on the integrating element.

17. The non-linear integrator of claim 16, wherein the output buffer element is a unity gain element.

18. The non-linear integrator of claim 1, wherein the non-linear integrator is used in a phase-locked loop (PLL) acquisition system.

19. The non-linear integrator of claim 1, wherein the non-linear integrator is used in a timer system.

20. The non-linear integrator of claim 1, wherein the non-linear integrator is used in a linear system.

21. A method for modifying the gain of a non-linear integrator of a closed loop system in order to avoid saturation in the acquisition range of the closed loop system while still experiencing a high gain characteristic at a desired linear portion of the system, comprising the steps of:

supplying a voltage input signal and a bias input signal to a gain element of the non-linear integrator, wherein the gain element has a gain;

generating an amplifier output signal of the gain element;

integrating the amplifier output signal to generate an output signal of the non-linear integrator;

generating a bias current responsive to the output signal of the non-linear integrator; and modifying the gain of the gain element responsive to the bias current, wherein the gain of the gain element is determined by the output signal of the non-linear integrator and is automatically decreased as necessary to avoid saturation.

22. The method of claim 21, wherein the step of generating an amplifier output signal of the gain element is accomplished by the bias input signal, a current source element coupled to the bias input signal of the gain element, and a feedback element of the non-linear integrator.

23. The method of claim 21, wherein the step of modifying the gain of the gain element is accomplished by modifying the bias current that is input to the bias input signal of the gain element.

24. The method of claim 23, wherein the step of modifying the gain of the gain element is accomplished by a feedback element of the non-linear integrator which provides the bias input signal to the gain element and a current source element coupled to the bias input signal of the gain element, wherein the feedback element modifies the bias input signal as a function of an integrating element coupled to the amplifier output signal of the gain element.

25. The method of claim 24, wherein when the feedback element generates no feedback, the bias input signal is determined by a current generated by the current source element; when the first bias source generates feedback, the bias input signal is equal to the current generated by the current source element decreased by a current generated by the feedback element.

* * * * *